United States Patent [19]

Deike

[11] 4,130,168

[45] Dec. 19, 1978

[54] DOWNCROWDING BOOM ASSEMBLY

[75] Inventor: Robert F. Deike, Cheyenne, Wyo.

[73] Assignee: Foresight Industries, Cheyenne, Wyo.

[21] Appl. No.: 732,076

[22] Filed: Oct. 13, 1976

[51] Int. Cl.[2] ..... E21C 5/00

[52] U.S. Cl. ..... 173/38; 173/43; 173/141

[58] Field of Search ..... 173/22, 28, 38, 43, 173/141, 152, 160

[56] References Cited

U.S. PATENT DOCUMENTS

| | | | |
|---|---|---|---|
| 2,423,787 | 7/1947 | Mosena et al. | 173/43 |
| 2,557,637 | 6/1951 | Danuser | 173/38 |
| 2,568,959 | 9/1951 | Illies | 173/141 X |
| 2,873,950 | 2/1959 | Kandle | 173/141 X |
| 2,917,953 | 12/1959 | Badali | 173/152 X |
| 3,017,935 | 1/1962 | Galbraith et al. | 173/38 |
| 3,117,635 | 1/1964 | Deerkoski | 173/28 |
| 3,252,526 | 5/1966 | Verrell et al. | 173/38 |
| 3,375,880 | 4/1968 | Pyles et al. | 173/38 |
| 3,604,521 | 9/1971 | Collins | 173/38 |
| 3,797,672 | 3/1974 | Vermette | 212/46 R X |
| 3,881,555 | 5/1975 | Cresp | 173/38 |

*Primary Examiner*—Lawrence J. Staab

*Attorney, Agent, or Firm*—Hill, Gross, Simpson, Van Santen, Steadman, Chiara & Simpson

[57] ABSTRACT

A self-contained, portable, extensible boom assembly for detachable mounting on a vehicle such as on the open top box body of a truck has power driven boom actuating mechanism and downcrowding storage mechanism activated by said power driven mechanism for maintaining a downcrowding load on a driver tool suspended from the boom together with mechanism for controlling the extension of the boom to maintain a straight line alignment of the tool as it advances under the downcrowding load. The portable with mechanism for controlling the extension of the boom to maintain a straight line alignment of the tool as it advances under the downcrowding load. The portable self-contained assembly can carry its own power source such as a battery or can be driven through a power take-off from the engine of the truck on which it is mounted. The assembly is unitary, relatively light in weight, easily transported, and is easily mounted on and removed from a truck vehicle without altering the construction of the vehicle.

21 Claims, 11 Drawing Figures

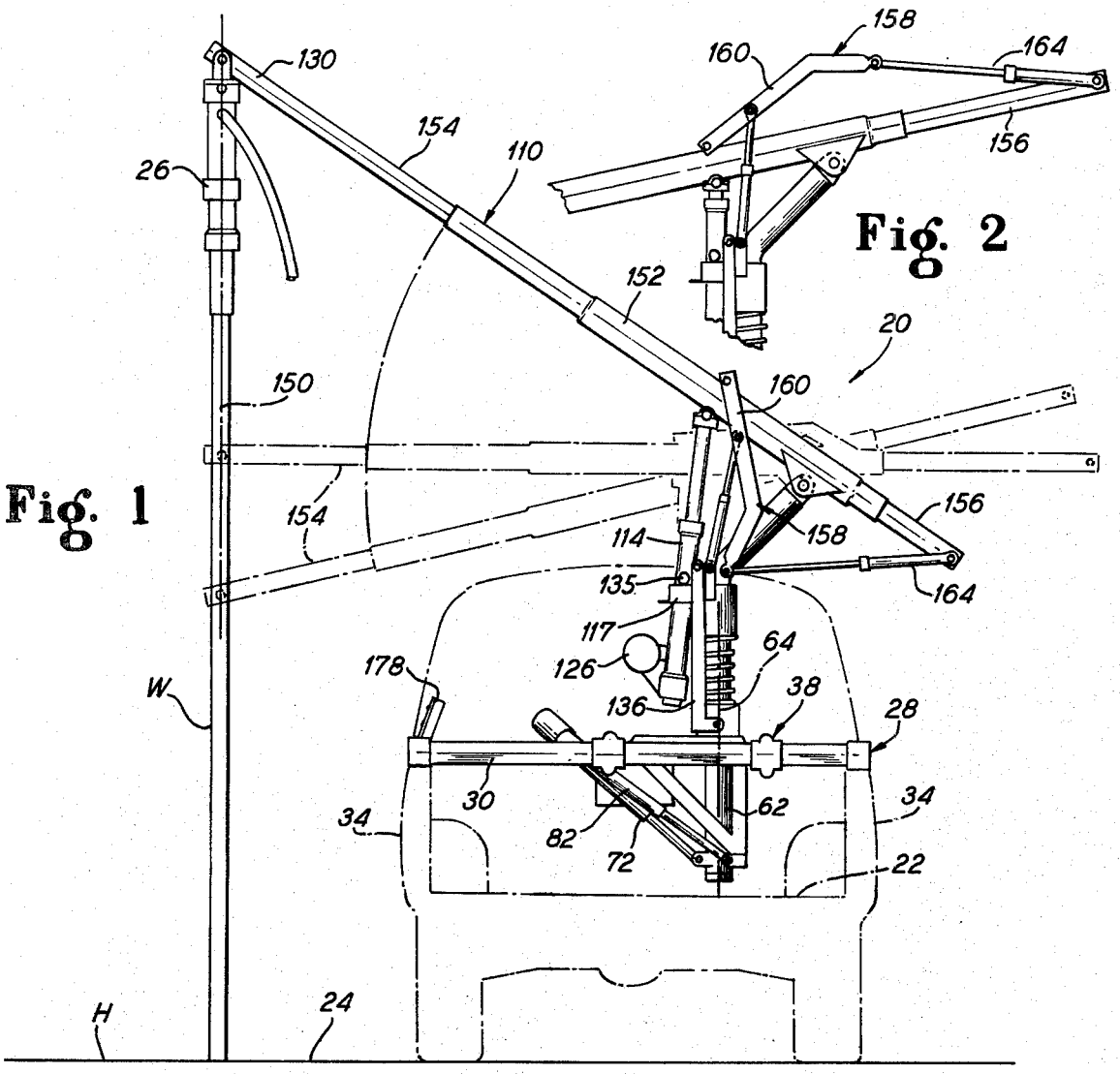
Fig. 1
Fig. 2
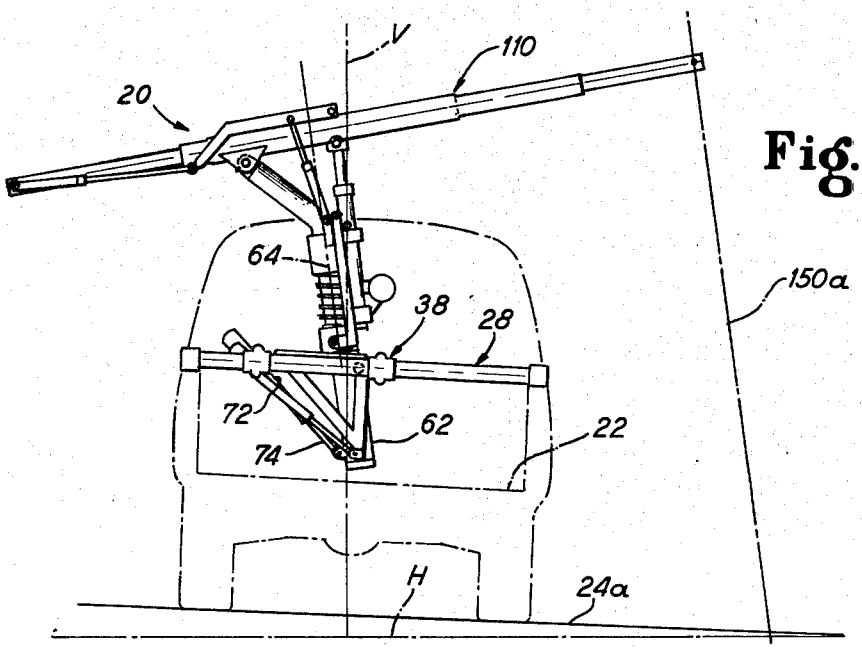
Fig. 3

DOWNCROWDING BOOM ASSEMBLY

FIELD OF THIS INVENTION

This invention relates to the art of portable boom assemblies and particularly deals with an extensible downcrowding boom assembly for driver tools such as jackhammers, drills or augers, adapted to be removably mounted on a vehicle such as a standard truck body.

PRIOR ART

Heretofore transportable boom assemblies and derricks have been permanently mounted on vehicles rendering the vehicles useless for other purposes. The power operated swingable boom of such assemblies could not apply any downcrowding loads to driver tools suspended therefrom without continuous application of power and could only apply the downcrowding load in an arcuate path centered on the boom pivot causing appreciable deviations in the path of the driver tool and preventing straight-line operation of the tool.

SUMMARY OF THIS INVENTION

This invention now overcomes the deficiencies of the prior art transportable boom assemblies by providing a self-contained portable assembly or unit which is easily detachably mounted on a standard transporting vehicle such as a truck body, thus freeing the vehicle for other use when the boom assembly is not needed. In addition, the invention provides energy-storage means to continue downcrowding loads on boom-suspended driver tools after cessation of power input to the assembly. Further, the invention provides controls for automatically extending and contracting the boom lengths as the boom swings about its pivot mounting so that driver tools suspended from the boom will be loaded in a straight-line direction which is predetermined by the setting of the assembly.

According to a preferred embodiment of this invention a lightweight base frame is detachably mounted on the sidewalls of an open top box truck body to transversely span the truck. A carriage on the frame mounts a pedestal which supports a swing post on which an extensible boom is pivoted. Power means drive the carriage along the frame to position the pedestal at the work site. Additional power means control the attitude of the pedestal relative to the truck for maintaining a desired axis of rotation for the swing post independently of the attitude of the truck body. The post rotates relative to the pedestal for horizontal swinging of the boom. Power means control the vertical swinging of the boom about its pivot on the post and also charge or load storage means for continuing the downcrowding of the boom assembly after power input to the assembly is terminated.

The driver tool such as the jackhammer, power drill or the like, is suspended from the extensible portion of the boom and the extension of the boom is automatically controlled to maintain a straight line loading of the tool as the boom is swung about its pivot advancing the tool relative to the work surface on which it is operating.

The boom assembly of this invention is especially useful in mounting and downcrowding jackhammer tools for driving posts into the ground, for downcrowding and guiding demolition tools and for holding the tool in a straight line as it advances during use.

It is then an object of this invention to provide an inexpensive, self-contained, portable, boom unit for detachable mounting on standard vehicles thereby freeing the vehicles for other uses when the boom assembly is not needed.

Another object of this invention is to provide a downcrowding extensible boom assembly for driver tools which maintain a straight line application of driving force on the tool at a controlled attitude.

Another object of the invention is to provide an extensible boom assembly which is easily mounted on and removed from the sidewalls of an open top box truck body and energized from a power source carried thereby or from the engine of the truck to selectively position the end of an extensible boom at a desired position at a work site.

Another object of the invention is to provide a downcrowding boom assembly which stores energy to be delivered as a driver tool suspended from the assembly advances in operation.

A still further specific object of the invention is to provide a self-contained portable boom assembly for mounting on trucks which is electrically operated from a single control station.

A feature of the invention resides in the provision of a downcrowding spring on a boom assembly which is loaded by power mechanism for pivoting the boom to deliver downcrowding loads to a tool suspended from the boom after power input to the boom is stopped.

Another feature of the invention is to provide an extensible boom assembly with automatic control of the extension and contraction of the boom to maintain the end of the boom in a single plane throughout a long-swinging arc of the boom.

Other and further objects of this invention will become apparent to those skilled in this art from the following detailed description of the annexed sheets of drawings, which, by way of preferred embodiment illustrate several examples of the invention.

BRIEF DESCRIPTION OF THE DRAWINGS

FIG. 1 is a side elevational view of a self-contained, portable, straight line downcrowding boom apparatus of the present invention, mounted on a truck body viewed from the rear, for operable support of a driving tool.

FIG. 2 is a fragmentary view of the straight line crowding actuator linkage shown in FIG. 1, but pivoted to a lowered position.

FIG. 3 is a view similar to FIG. 1 at a reduced scale, and showing the crowding apparatus positioned relative to the truck and ground for operably supporting a crowding and driving tool along a nonvertical straight line course.

DETAILED DESCRIPTION

Referring to drawings in FIG. 1, there is shown a self-contained, portable, straight-line downcrowding apparatus 20 removably mounted on an open box type truck body 22 for adjustable movements relative to the ground 24 to provide a desired straight line, generally downward crowding force for the operation of a driver tool 26 such as a jackhammer, drill, or auger. The crowding apparatus 20 is well suited for use with high speed reciprocating hammers whether powered by air, gasoline engines or hydraulic fluids for driving posts and the like into the ground for use with highway marker signs, fences and the like.

Figure 4:
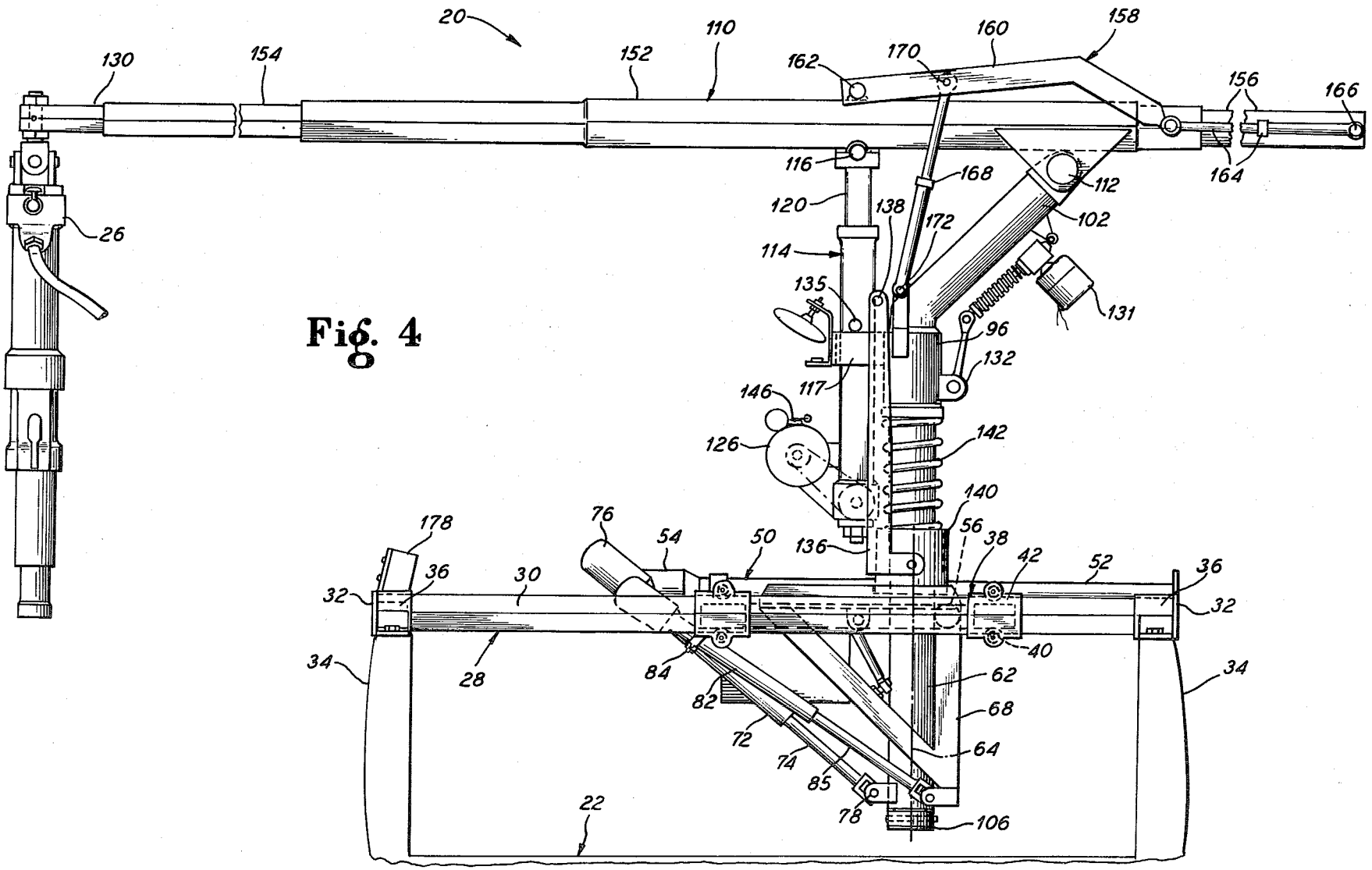
FIG. 4 is an enlarged side elevational view of the crowding apparatus of FIG. 1 shown in an intermediate unloaded position suspending a driving tool for placement at a work site.
Figure 5:
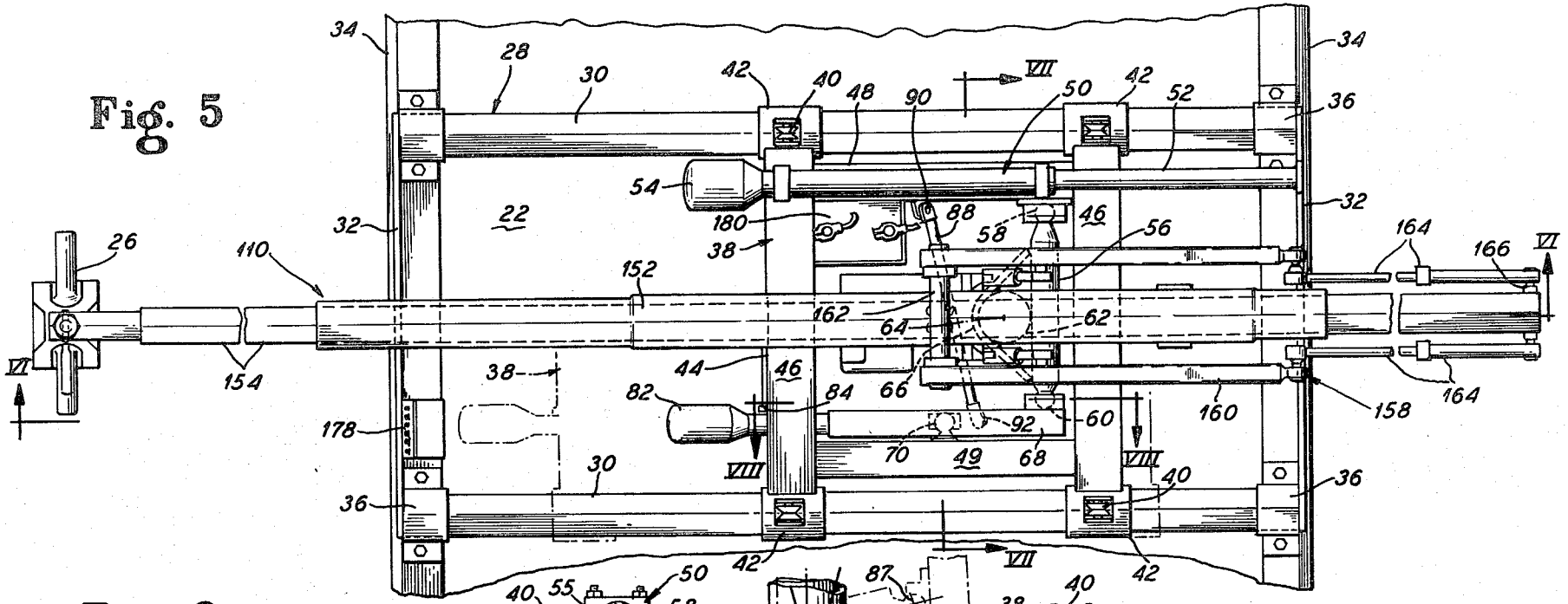
FIG. 5 is a plan view of the crowding apparatus of FIG. 4.

Now, with specific reference to FIGS. 4 and 5, a self-contained, portable, straight-line downcrowding apparatus 20 is shown in position for suspending a driver tool at a work site, and comprises a support frame 28 having a pair of spaced tubular rail members 30 joined at their ends by cross plates 32 and secured to the sidewalls 34 of the truck body 22 by mounting brackets 36. The tubular rails 30 are generally diamond shaped in cross section and extend laterally across the width of the truck body 22 between top edges of the sidewalls 34 to provide lateral adjustable support for a carriage 38. The carriage 38 is guidably supported for adjustable movement along the rails 30 by four pairs of "V" grooved rollers 40. Each pair of rollers 40 is held in a roller bracket 42 in vertical aligned orientation wherein the "V-grooved rollers cooperate with an upper and lower edge of the rails 30 to provide a stable rolling support for the carriage 38 along the length of rails.

The carriage 38 includes a frame 44 having a pair of spaced cross members 46 and a pair of side members 48 and 49. Each cross member 46 extends between the spaced rail members 30 with each end thereof carried by one of the roller brackets 42 and each side member 48 and 49 extends between the spaced cross members 46 and along the adjacent inner edges of the rail members 30.

A power screw 50 is secured to the carriage 38 with an extensible end 52 of the power screw 50 fixed to a cross plate 32 of the support frame 28. A reversible motor drive 54, when energized powers an internal screw 55 to extend or retract the extensible end 52 of the power screw 50 to provide a positive locking adjustment of the carriage 38 along the rails 30. The adjustment of the carriage 38 not only provides for positioning the driver tool 26 relative to the side of the truck frame 22 but further provides a means of more uniformly distributing the reactive forces associated with the downcrowding operation on the truck springs (not shown).

A pivot shaft 56, supported at its ends in ball joints 58 and 60 in the carriage 38, is arranged to support an upright mounting pedestal 62 for adjustment of an upright swing axis 64 extending along the center of the pedestal, relative to the carriage 38 and support frame 28. A strap 66 and a pair of angled braces 67 rigidly attach the pedestal 62 to the pivot shaft 56 for longitudinal and lateral adjustable movement therewith. The ball joint 58, supporting one end of the pivot shaft 56, is secured to the carriage frame side member 48 and the ball joint 60, supporting the second end of the pivot shaft, is secured to a triangular leveling frame 68. The leveling frame 68 is supported on a ball joint 70 secured to the side member 49 of the carriage frame 44. The ball joints 58, 60 and 70, permit a degree of universal movement of the pivot shaft ends and the leveling frame to provide a universal adjustment of the mounting tube or pedestal 62 to position its upright swing axis 64 at the required inclination or in most instances to an upright vertical orientation.

Figure 6:
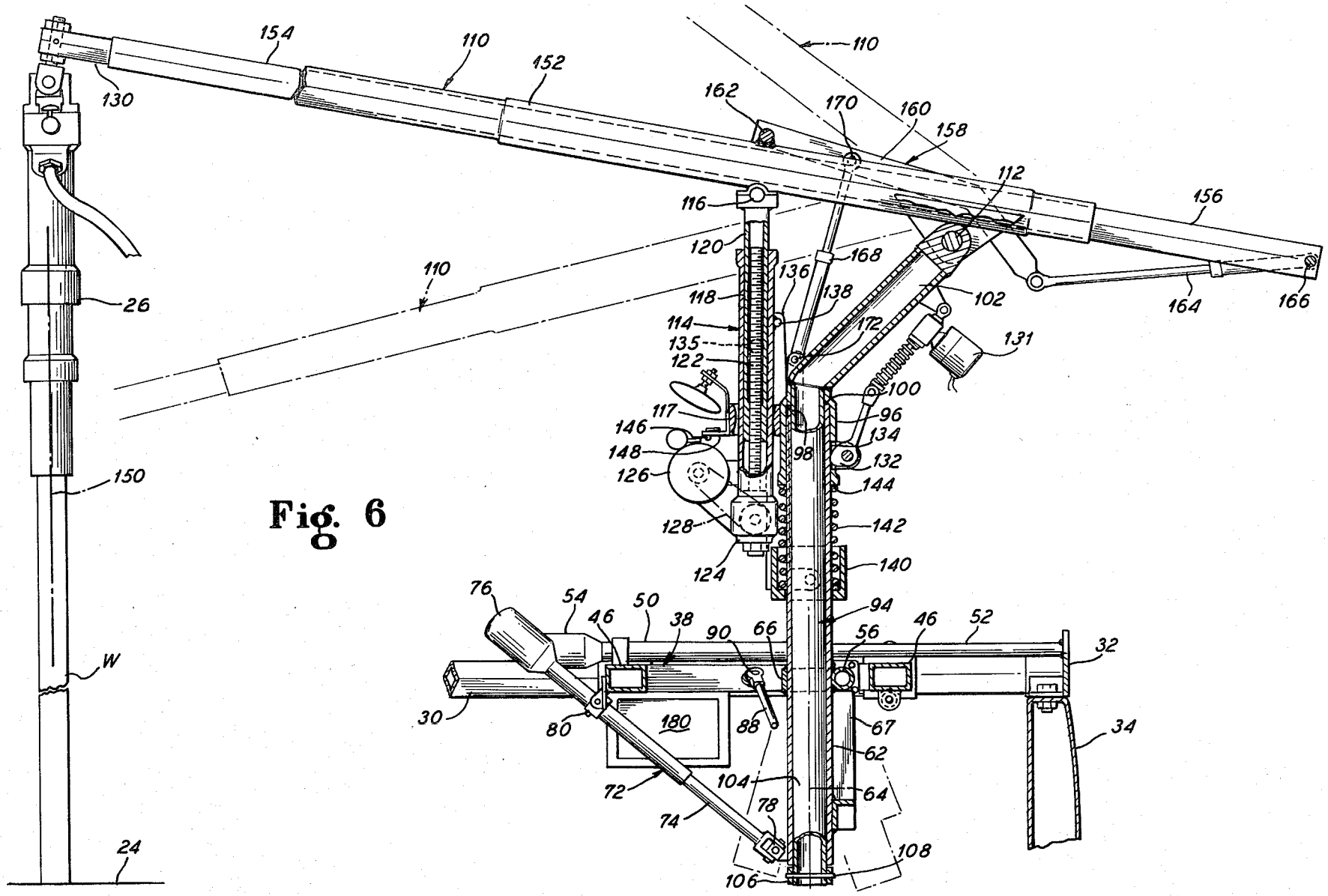
FIG. 6 is a sectional view taken generally along the line VI—VI of FIG. 5.

It should be noted that the truck body 22 carrying the crowding apparatus may frequently be used on uneven sloping terrain 24*a*, as best seen in FIG. 3, which will place the support frame 28 along with the carriage 38 at an angle relative to the horizontal line H. Herein, "truing" of the swing axis 64 to a vertical position will require energization of a power screw 72 as best seen in FIG. 6, to retract an extensible end 74 thereof and causing the swing axis 64 of the pedestal 62 to tilt toward the upright vertical position as indicated in FIG. 3 by the line V. It will be noted that in this instance while the swing axis 64 is adjusted to align with the vertical line V, which is perpendicular to the horizontal H, the swing axis 64 will be disposed at an angle which is not perpendicular to the tubular rail members 30 due to the tilted attitude of the truck. The power screw 72 is similar to the power screw 50 having a reversible motor drive 76 effective to extend or retract its extensible end 74 which is connected to the lower portion of the pedestal 62 by means of a universal connection 78 while a universal connection 80 connects the power screw 72 to the carriage 38.

Figure 7:
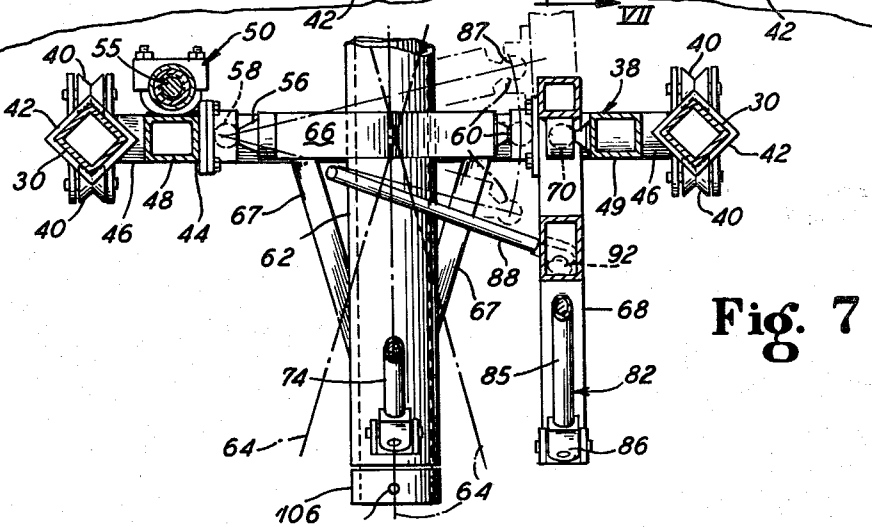
FIG. 7 is a fragmentary enlarged sectional view taken generally along the line VII—VII of FIG. 5.
Figure 8:
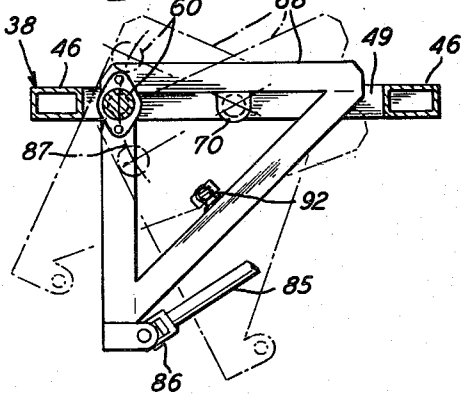
FIG. 8 is a fragmentary sectional view taken generally along the line VIII—VIII of FIG. 5.

As best seen in FIGS. 7 and 8, the triangular leveling frame 68 which supports one end of the pivot shaft 56 by means of a ball joint 60, is mounted for pivotal movement on the ball joint 70. A power screw 82, similar to the power screw 72, is also carried on the carriage 38 by means of a universal connection 84 with an extensible end 85 of the power screw 82 connected to the lower end of the leveling frame 68 by means of a universal connection 86 to provide pivotable adjustment of the leveling frame 68 and cause the ball joint 60 with the supported end of the pivot shaft 56 to raise or lower relative to the carriage frame 44 as best seen in FIG. 7. The leveling frame 68 with the ball joints 60 and 70 provide an ideal means for supporting the pivot shaft 56 which permits the ball joint 60 to move along the arc 87. However, this mounting renders the lower end of the leveling frame 68 unstable. Accordingly, a bracing link 88 is connected between the side member 48 of the carriage 38 and the leveling frame 68 by means of a universal connection 90 and 92 to provide a three-point stabilized mounting of the leveling frame and permit the screw jack 82 to apply the required pivotal adjustment force to the lower end of the leveling frame 68.

As shown in FIG. 6, a swing post 94 is rotatably mounted in the mounting tube pedestal 62 for 360° horizontal swinging movement about the upright swing axis 64. The swing post 94 includes an enlarged guide sleeve portion 96 extending downward and coaxially around the outside of the pedestal 62 and having an annular bearing face 98 resting on a complementary bearing support face 100, defining the top annular edge of the pedestal 62. The swinging post 94 further includes an upward angular pivot boom support portion 102 and a journal portion 104 extending downward through the pedestal 62 and having a retaining collar 106 fastened about an exposed end of the post 94 by a securing pin 108. Thus, the post is mounted in the pedestal 62 by the bearing support face 100 and the retaining collar 106.

An extensible boom 110 is pivotally supported on the boom pivot support 102 of the swing post 94 by means of a horizontal pivot pin 112. The boom 110 is supported for a pivotal movement through a given vertically disposed arc, a power means 114, pivotally connected to the boom 110 as at 116 and supported by a guide support member 117 secured to the sleeve portion 96 of the swing post 94. As best seen in FIGS. 4 and 6, the power means 114 comprises a power screw 118 having an extensible sleeve end 120 which is pivotally connected to the boom 110 by means of a connecting pin 116. The lower end of the extensible sleeve 120 engages a driven screw extending from a right angle drive gear reducer 124. A high torque, reversible electric motor 126 powers the gear reducer 124 by means of a sprocket chain drive 128.

After the swing post 94 is adjusted to a required upright setting relative to the horizontal line H, the boom 110 may be manually swung about the swing axis 64 to locate an extensible crowding end portion 130 of the boom to a desired work site alongside the truck bed 22. A position locking means 131 is then activated to set a friction locking cam means 132 against an exposed surface 134 of the pedestal 62. While the boom is thus held in a desired swung position, a substantial external boom swing force inadvertently applied against the boom would be absorbed by a yielding of the friction lock to thereby prevent damage to the boom structure.

The reversible electric motor 126 when driving the screw 122 relative to the extensible sleeve 120 selectively raises or lowers the boom 110 for positioning the driving tool 26 relative to a workpiece W. At this time a pair of bosses or lugs 135 projecting from opposite sides of the power means 114 support the boom on the guide support member 117, as best shown in FIGS. 1 and 4. Thereafter, when the workpiece W is positioned and resists downward movement of the down-crowding end 130 of the boom, continued activation of the reversible motor 126 to retract the extensible sleeve 120 serves to elevate the power means 114 and to raise therewith a pair of links 136 connected to the power screw 118 by coupling pin 138. The links 136 extend downward from the coupling pin 138 along opposite sides of the pedestal 62 and are connected to a compression sleeve 140, slidably carried around the mounting tube pedestal 62 for compressive engagement with a power storage compression spring 142. The compression spring 142 is also carried around the pedestal 62 between the compression sleeve 140 and a lower abutting edge 144 on the sleeve portion 96 of the swing post 94. The links 136 thus lift the compression sleeve 140 upward against the lower end of the spring 142 to compress the spring and provide a stored downcrowding load applicable to the driving tool 26 and against the top of the workpiece, after the reversible electric motor 126 is stopped. The post 94 is restrained against raising on the pedestal 62 under the influence of the spring load by the retaining collar 106 which is affixed to the lower end of the post 94 and abuts the bottom edge of the pedestal.

After the reversible motor 126 has suitably compressed the spring 142 through the action of the power screw 118, the motor is automatically stopped by a limit switch 146 abutting the finger portion 148 of the guide support member 117. A full downcrowding force, now stored in the spring, is applicable over a substantial downward driving movement of the workpiece W (approximately 5 feet) before the reversible motor 126 needs to be reactivated to again compressively load the spring 142 for additional downcrowding movement of the boom 110.

The extensible boom 110 is provided with a straight line downcrowding action through a predetermined vertical pivotal arc in which the crowding end 130 follows a straight line downward course identified in FIG. 1 as the line 150. Herein, a generally diamond shaped support portion 152 of the boom is pivotally mounted to the post on the pivot pin 112, and a complementary shaped extensible tube member 154 is sliably carried in said support portion 152 with one end of the tube member extending forwardly therefrom and comprising the crowding end 130 from which the driving tool 26 is supported and a second end extending rearwardly from the support portion 152 comprising an operating end 156. A control linkage 158, connected between the operating end 156 and the support portion 152 controls the extensible movements of the crowding end 130 relative to the support portion 152 to follow the straight line downward course 150. The linkage 158 comprises a pair of angled lever arms 160 pivotally carried by a pin 162 mounted on the support portion 152 and extending along opposite sides thereof with each lever arm 160 connected by means of a connection link 164 to the operating end 156 by a connecting pin 166. A pair of control links 168 are connected at an upper end to each of the lever arms 160 by means of pins 170, intermediate the pivot pin 162 and the connection links 164, and extending downward for connection to the post 94 by means of a pivot connection 172.

The links 164 and 168 are preferably adjustable to accurately calibrate the extension response of the tube member 154 in accordance with the vertical swinging position of the extensible boom 110 to follow along the straight-line course 150. As best seen in FIGS. 1, 2 and 6, the control linkage 158 provides for maximum extension of the extensible tube member 154 when raised as shown in solid lines in FIG. 1, with the operating end 156 fully retracted by the pivotal action of the control linkabe 158. As the boom 110 moves downward following the power tool 26, responsive to the release of downcrowding energy stored in the compression spring 142, the control linkage 158 effects a retraction of the crowding end portion 130 of the extensible tube member 154, reaching the fully retracted position at the horizontal broken line position shown in FIG. 1. Herein, in moving from the raised solid line position to the horizontal broken line position, the power tool supported from the downcrowding end 130 maintains a straight-line descent along the line 150. In the horizontal position, it will be observed that the control linkage 158 has forced the operating end 156 of the tube member 154 to a maximum withdrawn position relative to the support portion 152. Continuing downward to the lowered position shown in broken lines in FIG. 1, the control linkage again extends the extensible tube member 154 to continually follow the line 150. The control linkage 158 at this point moves to the position as shown in FIG. 3. Since the straight-line course 150, along which the downcrowding force is applied to maintain alignment with the workpiece W, is always parallel to the swinging axis 64. It is a simple matter when desired to angle drive a workpiece along an inclined course 150*a* as shown in FIG. 3. Herein, it will be seen that although the truck body 22, is parked on a sloping ground surface 24*a*, the swing axis 64 may be tilted relative to the vertical line V and relative to the truck body by a previously described adjustment procedure, to apply a downward crowding force along the line 150*a*. Further, the extensible boom 110 may be horizontally swung about the swing axis 64 to operate from either side of the truck body 22 and may be effectively used in a wide range of "OFF" vertical downcrowding courses as may be required in certain operations.

A control station panel 178, supported by the cross plate 32 of the support frame 28, provides a convenient grouping for electrical controls for the power screws 50, 72 and 82, for the adjustment of the pedestal 62; and for the reversible motor 126 used to adjust the boom height and to compress the spring 142; and for setting the cam lock 132 to fix the swing position of the boom 110 at the work site. A self-contained power source comprising a standard storage battery 180 is carried on the carriage 38 with suitable electrical connections to the control panel 178. It will be appreciated that the various electric motors are driven for comparatively short periods of time and do not impose a rapid power drain on the battery 180. It will also be remembered that the downcrowding loads are produced by the compression spring 142, enabling the reversible electric motor 126 to remain in the off position throughout most of the crowding cycle. Further, since the power screws are self-locking when not operating, the various adjustments provided by them are positive and do not require continuous operating power demanding devices as associated with a hydraulic or pneumatic power system.

Figure 9:
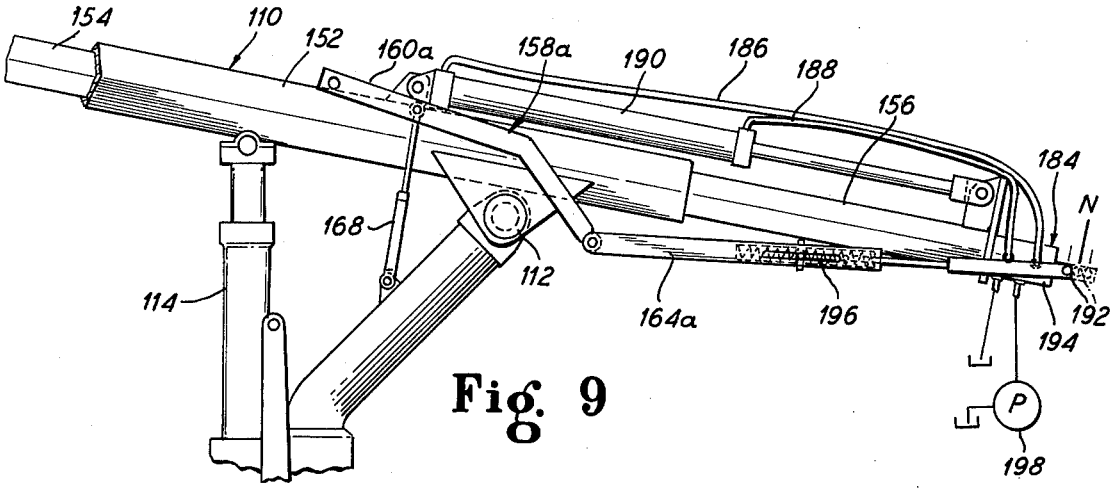
FIG. 9 is an enlarged view similar to FIG. 2, but showing an alternate form of the straight line crowding actuator linkage utilizing a hydraulic cylinder to control extensible movements of the boom arm.

Now, with particular reference to FIG. 9, there is shown an alternate means for providing the straight-line downcrowding course as heretofore described. A control linkage 158*a* is utilized, which is similar in operation to the control linkage 158, but constructed at a considerable smaller scale with only a single lever arm 160*a* and link 164*a* needed to regulate a four-way fluid valve 184. The valve 184, carried on the operating end portion 156 of the extensible tube 154 directs a pressure flow to one of the pressure lines 186 or 188 to extend or retract a cylinder 190 connected between the support portion 152 and the control end 156 of the extensible boom 110. Accordingly, as the control linkage 158*a* swings responsive to the vertical movement of the extensible boom 110, a pulling or pushing force is exerted on a valve spool 192 of the valve 184 to pressurize an appropriate line to activate the cylinder 190. The valve spool 192 as shown in FIG. 9, is moved by the linkage 158*a* from a neutral position designated 'N' to a position relative to a valve body 194 of the valve 184 to pressurize the line 188. This pressurization of the line 188 is effective to retract the cylinder 190 and slide the control end 156 of the extensible tube member 154 further into the support portion 152 of the boom 110, thus extending the crowding end portion 130 and moving the valve body 194 relative to the spool 192 to thereby return the spool to is neutral position 'N' and discontinue further pressure flow to the cylinder 190.

Thus, it will be seen that the valve body 194 which is attached to and moves with the control end 156 of the extensible tube member 154, is attempting to return the valve spool 192, which is moved by the action of the control linkage 158*a*, to the neutral position, providing a "feedback" means to synchronize the movement of the extensible tube member 154 with the control linkage 158*a*. The control linkage 158*a* thus initiates the desired pressure flow to the cylinder 190 and the feedback means is effective to halt the flow of pressure to the cylinder 190 after the crowding end portion 130 reaches its proper extended position. Thus, while there are minimal lags of responsiveness by the cylinder 190 to extend the extensible tube member 154, there is still effective responsiveness by the embodiment of FIG. 9 to generally maintain the straight-line downcrowding course 150. The link 164*a* is equipped with an over-travel means 196 which provides a yieldable connection to the valve spool 192 to comprensate for these minimum lags in the movement in the tube member 154 relative to the control linkage 158*a*. With this embodiment, a pressure source such as a pump 198 will be required to provide the necessary fluid pressure to power the cylinder 190. This pump would normally be driven by a power take-off (not shown) on the truck.

Figure 10:
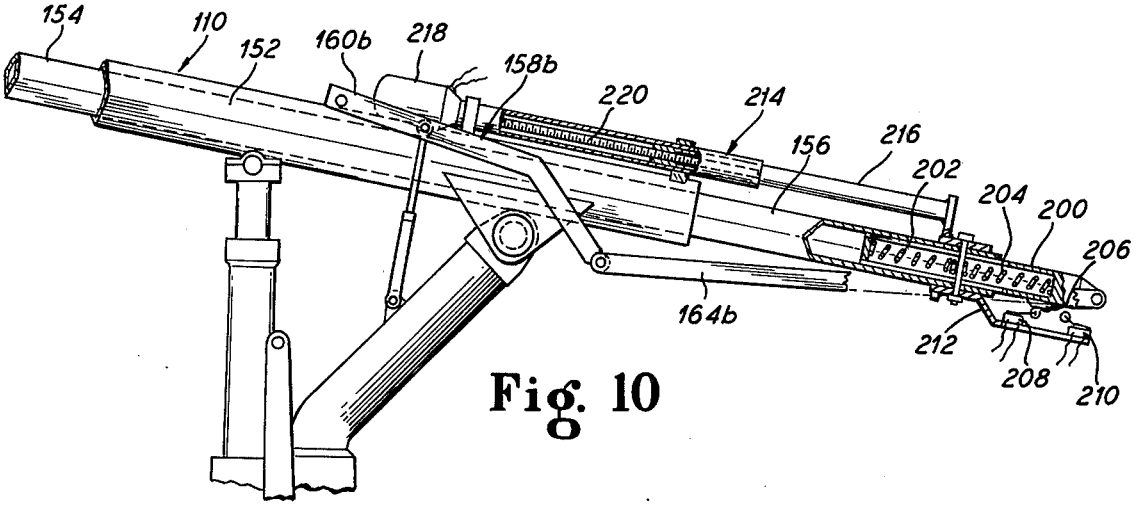
FIG. 10 is a view similar to FIG. 9, but showing still another form of the straight line crowding actuator linkage utilizing a power screw to control the extensible movements of the boom arm.

In FIG. 10, there is shown still another means for providing the straight line downcrowding course to be followed by the extensible boom 110. Herein, a control linkage 158*b*, similar to the linkage 158*a* is provided to control a switch activating member 200 slidably supported in the control end portion 156 of the extensible tube member 154. The switch activating member 200 is biased in a centered position by a pair of opposing springs 200 and 204, whereby a camming projection 206, carried on the activating member 200 is centered between a pair of limit switches 208 and 210. The limit switches 208 and 210 are supported by a bracket 212 attached to the control end portion 156. In the position shown in FIG. 10, a lever arm 160*b* and a link 164*b* of the control linkage 158*b* has shifted the tube member 200 to the left, and further into the extensible tube 154, against the bias of the spring 204. This inward movement of the switch activating member 200, with the attached camming projection 206 closes electrical switch 208 to activate a power screw 214. The power screw 214 is attached to the support portion 152 of the extensible boom 110 and has an extensible sleeve end 216 secured to the boom control end 156 by means of the bracket 212. Closing the limit switch 208 energizes a reversible motor drive 218 to turn a screw 220 into a threaded end of the extensible sleeve 216 and effectively retract the power screw sleeve 216. Accordingly, the operating end 156 of the tube member 154 moves along with the power screw sleeve 216 to shift the limit switch 208 out of contact with the camming projection 206 and thereby turning off power to the motor drive 218. Thus, it will be seen that a "feedback" means is provided which continuously senses the extended position of the extensible tube 154 relative to the vertically swung position of the boom 110.

Figure 11:
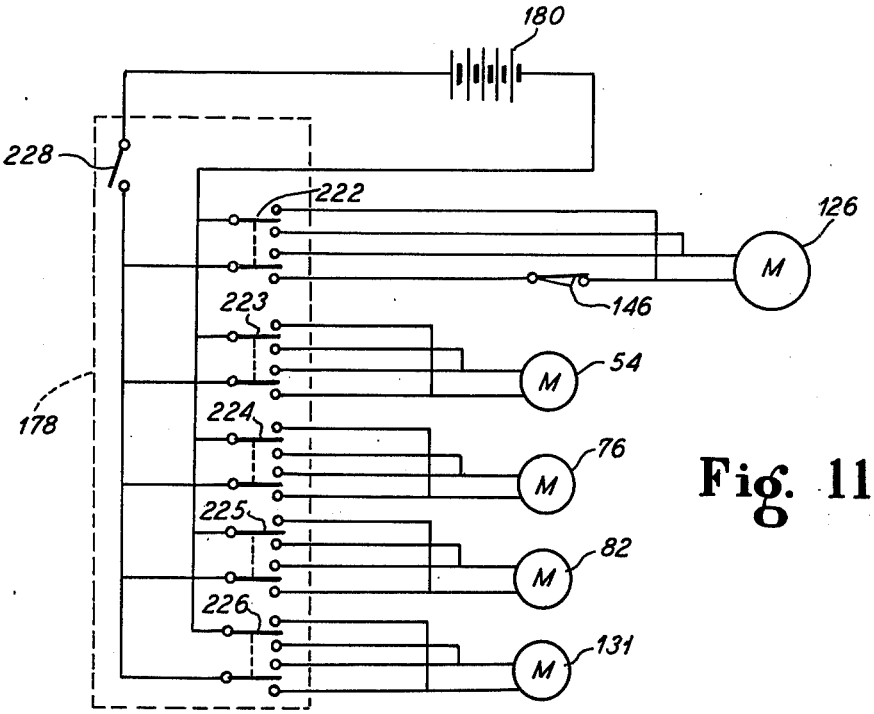
FIG. 11 is a schematic diagram of the electrical system for the present invention.

A schematic diagram of the electrical system for the downcrowding apparatus 20 is illustrated in FIG. 11. Each of the power screw motors, the reversible electric motor 126 and the locking means 131 are controlled from the control panel 178 by direction reversing switches 222, 223, 224, 225 and 226. The normally closed limit switch 146 is provided in the line to the motor 126 for stopping the motor after the spring 142 is fully compressed as previously described. A main control switch 228 may also be used to deactivate the entire circuit.

Although several embodiments of the invention have been described and defined herein, it is not to be so limited as to preclude other modifications and alterations to be made thereto as may be reasonably and properly included within the scope of the appended claims.

I claim as my invention:

1. A self-contained portable downcrowding boom assembly for driving tools which comprises an elongated base frame adapted to be removably mounted on a truck body to span the body, a carriage supported by said base frame movable along the length thereof, an upright pedestal carried by said carriage, a post rotatably mounted on said pedestal, a boom pivoted on said post and rotatable with said post, a driving tool suspended from said boom, power means swinging the boom about the pivot on the post, and power storage means energized from said power means for downcrowding the tool mounted on said boom to continue a downcrowding load on the tool after said power means is stopped.

2. The self-contained portable boom assembly of claim 1, wherein the pedestal is carried by said carriage on an adjusting means arranged to support said pedestal at a predetermined upright attitude relative to the carriage.

3. The self-contained portable boom assembly of claim 2, wherein the adjusting means includes means to tilt the upright attitude of the pedestal in all planes.

4. The self-contained portable boom assembly of claim 3, wherein a power means is selectively operable to adjust the tilting of said pedestal to said predetermined upright attitude.

5. The self-contained portable boom assembly of claim 4, wherein the power means comprises a pair of power screws connected between the pedestal and the carriage to adjust and fixedly support the pedestal in said predetermined upright attitude.

6. The self-contained boom assembly of claim 5 wherein the carriage is laterally adjustable relative to the base frame by a power screw.

7. The self-contained portable boom assembly of claim 1, wherein said boom includes an extensible portion slidably carried in a support portion thereof, said extensible portion having a free end, and a control means automatically moves said extensible portion relative to the support portion when pivoting the boom through a predetermined are to control said end of the extensible portion for following a straight-line downcrowding course.

8. The self-contained portable boom assembly of claim 7, wherein the control means comprises a mechanical linkage connected between the support portion and the extensible portion of the boom to automatically move the crowding end along the straight-line downcrowding course.

9. The self-contained portable boom assembly of claim 7, wherein the control means comprise a control linkage connected between the support portion of the boom and a valve having a valve body, a valve spool in the body and a fluid cylinder connected between the support portion and the extensible portion of the boom, wherein the fluid cylinder is activated by relative movement between the valve body and valve spool to automatically move the free end along the straight-line downcrowding course.

10. The assembly of claim 7, wherein the control means includes a switch means, a switch activating means and a control linkage, said control linkage connected between the support portion and said switch activating means, said switch activating means being slidably carried by said extensible portion of the boom and said switch means being fixedly supported on the extensible portion, a power screw connected between the support and extensible portions of the boom and being activated by relative movement between the switch activating means and the switch means to automatically move the crowding end along the straight line downcrowding course.

11. A self-contained, straight-line, downcrowding boom apparatus comprising: a base frame; a pedestal adjustably carried by said base frame for adjustably positioning a generally upright swing axis for said pedestal in all planes relative to the base frame; a swing post journalled by said pedestal for rotational movement about said upright swing axis; a laterally extending boom secured to the swing post for pivotal movement about a horizontal pivot; means to pivot said boom about said horizontal pivot through a predetermined, vertically disposed arc; a telescoping boom member carried by said boom and having a crowding end thereon extending from said boom and pivotable therewith; and means to automatically and positively move the crowding end of said telescoping boom member when pivoting the boom through the predetermined arc, whereby the crowding end follows a straight line downcrowding course.

12. The self-contained, straight line, downcrowding boom apparatus of claim 11, which further comprises a power storage means and wherein the means to pivot said boom comprises a power means to energize the power storage means for downcrowding a tool mounted on said boom to continue a downcrowding load on the tool after said power means is stopped.

13. The self-contained, straight-line, downcrowding boom apparatus of claim 12, wherein the power storage means comprises a compression spring.

14. The self-contained, straight line, downcrowding boom apparatus of claim 13, wherein the power means includes means to automatically establish a desired maximum of spring compression.

15. The self-contained, straight line, downcrowding boom apparatus of claim 11, wherein the adjusting means includes a carriage for supporting the pedestal and being supported by said base frame and movable along the length thereof, and a pair of power screws connected between the pedestal and the carriage to adjust and fixedly support the pedestal in a predetermined upright attitude.

16. The self-contained, straight line, downcrowding boom apparatus of claim 15, which further includes a self contained power source of said power means and said power screws.

17. The self-contained, straight line, downcrowding boom apparatus of claim 11, wherein the means to automatically move the crowding end of said telescoping boom member includes a mechanical linkage connected between the boom, the telescoping member and the swing post, whereby pivoting of the boom about said horizontal pivot regulates the extension of the telescoping member to maintain the straight line downcrowding course.

18. The self-contained, straight line, downcrowding boom apparatus of claim 11, wherein the means to automatically move the crowding end of said telescoping boom member includes a control linkage and a fluid pressure system whereby pivoting of the boom about said horizontal pivot automatically regulates the fluid pressure system which is arranged to move the telescoping member to maintain the straight line downcrowding course.

19. The self-contained, straight line, downcrowding boom apparatus of claim 11, wherein the means to automatically move the crowding end of said telescoping boom member includes a control linkage, a power screw and an electrical control system whereby pivoting of the boom about said horizontal pivot energizes the electrical control system appropriately to drive the power screw which is arranged to move the telescoping member to maintain the straight line downcrowding course.

20. The boom assembly of claim 11 wherein the pedestal is mounted on a carriage carried by the base frame by means of a cross pivot shaft and a leveling frame, ball joints connect the ends of the cross pivot shaft with the carriage and the leveling frame, a ball joint mounts the leveling frame on the carriage, a power screw between the carriage and leveling frame swings the frame about the ball joint on the carriage to swing the end of the pivot shaft connected to the leveling frame for tilting the pedestal in one plane, and a second power screw between the pedestal and the carriage tilts the pedestal in another plane, whereby combined relative adjustments of the power screws will tilt the pedestal in all planes.

21. The boom assembly of claim 20 wherein the leveling frame is triangular, the ball joint mounting for the leveling frame on the carriage is intermediate the ends of one leg of the triangle, the ball joint connecting the one end of the pivot shaft with the leveling frame is at a corner of the triangle, the power screw between the carriage and the leveling frame is connected to the leveling frame at another corner of the triangle, and a link is provided between the carriage and a leg of the triangle spaced from the ball joint mounting for the frame on the carriage and from the ball joint connecting the pivot shaft and the frame.

* * * * *